US005402059A

United States Patent [19]

Bittar

[11] Patent Number: 5,402,059

[45] Date of Patent: Mar. 28, 1995

[54] SWITCHING POWER SUPPLY OPERATING AT LITTLE OR NO LOAD

[75] Inventor: Hussein I. Bittar, Dearborn, Mich.

[73] Assignee: Ford Motor Company, Dearborn, Mich.

[21] Appl. No.: 193,587

[22] Filed: Feb. 8, 1994

[51] Int. Cl.[6] ..... G05F 1/613

[52] U.S. Cl. ..... 323/223

[58] Field of Search ..... 323/223, 226, 247, 248, 323/265, 270, 271, 273, 276, 282, 289; 307/231, 350, 354, 358

[56] References Cited

U.S. PATENT DOCUMENTS

| | | | |
|---|---|---|---|
| 3,524,124 | 8/1970 | Perkinson | 317/16 |
| 3,670,230 | 6/1972 | Rooney et al. | 323/282 |
| 4,359,679 | 11/1982 | Regan | 323/272 |
| 4,439,722 | 3/1984 | Budnik | 323/248 |
| 4,465,966 | 8/1984 | Long et al. | 323/248 |
| 4,468,722 | 8/1984 | Kammiller | 363/71 |
| 4,720,775 | 1/1988 | Cathell | 363/15 |
| 4,763,014 | 8/1988 | Model et al. | 307/66 |
| 5,260,644 | 11/1993 | Curtis | 323/223 |

FOREIGN PATENT DOCUMENTS

| | | | |
|---|---|---|---|
| 55-82317 | 6/1980 | Japan | G05F 1/45 |
| 57-103522 | 6/1982 | Japan | G05F 1/58 |
| 58-16312 | 1/1983 | Japan | G05F 1/46 |
| 58-64515 | 4/1983 | Japan | G05F 1/46 |
| 58-215969 | 12/1983 | Japan | H02M 3/28 |
| 58-222781 | 12/1983 | Japan | H02M 3/28 |
| PCT/JP85/0-0524 | 9/1985 | Japan | H02M 7/06 |

OTHER PUBLICATIONS

Ferro-Resonant Transformer with Power Supply Regulation, by W. Hemena; vol. 22 No. 7 Dec. 1979, IBM Technical Disclosure Bulletin, pp. 2903-2904.

*Primary Examiner*—Steven L. Stephan
*Assistant Examiner*—Matthew V. Nguyen
*Attorney, Agent, or Firm*—Mark S. Sparschu; Roger L. May

[57] ABSTRACT

A switching power supply contains a transformer. Connected on the secondary side of the transformer is a dummy load circuit. The dummy load circuit rectifies, voltage divides and low-pass filters the signal on the secondary side of the transformer. If the output of the low-pass filter is below a predetermined value, it is recognized that an insufficient load (which might be no load at all) is connected to the output of the switching power supply. In that case, the dummy load circuit activates a transistor which switches a dummy load resistor across the output of the power supply to assure at least a predetermined minimum electrical load on the output. If the electrical loads on the output of the switching power supply include a voltage source such as a battery, a relay is connected in series with the dummy load resistor within the switching power supply. The relay opens when the switching power supply is turned off, to prevent inadvertent leakage current from the voltage source through the transistor which switches the dummy load resistor.

15 Claims, 2 Drawing Sheets

SWITCHING POWER SUPPLY OPERATING AT LITTLE OR NO LOAD

BACKGROUND OF THE INVENTION

1. Field of the Invention

The present invention relates to a DC switching power supply.

2. Description of the Related Art

In DC power supplies known as "switched-mode" or "switching" power supplies, a transformer is typically employed. This transformer converts an input waveform with a given duty cycle, amplitude and frequency into a waveform with an average value approximately equal to the desired DC output voltage of the power supply. An L-C (inductive-capacitive) low-pass filter is then typically used to provide that average value as the output of the power supply. The inductor is in series with the secondary of the transformer, and the capacitor is shunted to ground. One or more electrical loads are connected to the output of the power supply.

A problem can occur when loads on the output of a switching power supply become disconnected from the supply. When this occurs, the output current from the power supply becomes reduced (or eliminated if all loads become disconnected). If the output current becomes small enough, the output voltage of the power supply can reach the peak value of the secondary voltage of the transformer of the power supply. This occurs because with a very small output current, the inductor in the L-C low-pass filter does not drop much voltage (if any at all). The capacitor in the L-C low-pass filter therefore charges up to the peak voltage of the secondary of the transformer. This peak voltage is generally considerably higher than the average voltage of the secondary of the transformer. The higher voltage which occurs across the capacitor, and therefore also at the output of the power supply, can damage components within the power supply. The higher voltage can also damage any remaining electrical loads connected to the power supply.

To prevent the voltage at the output of a power supply from rising in the manner just described, it is desirable to assure that current above a predetermined minimum is drawn from the output of the power supply at all times. One means of assuring such a minimum current draw is to connect a dummy resistor inside the power supply across the output terminals of the power supply. This resistor is sized to draw a current above the minimum necessary to prevent the output voltage of the power supply from rising. However, because this dummy resistor is always connected to the output of the power supply, the energy it consumes represents a reduction of efficiency for the power supply. Furthermore, in the event that the switching power supply is used to charge a battery, the battery will discharge through the dummy resistor when the switching power supply is turned off.

U.S. Pat. No. 3,524,124 discloses a system which switches a dummy load, a transistor, onto the output of a power supply in response to the output voltage of the supply rising above a predetermined level.

Japan Patent No. 58-64515 discloses a system which switches a dummy load, also a transistor, onto the output of a power supply if the output current from the supply drops below a predetermined level. The output current is measured with a shunt. Although this method can be effective, a shunt which can measure current of significant magnitude is a very expensive component.

SUMMARY OF THE INVENTION

The present invention provides a switching power supply with an output, the power supply including voltage transformation means with an output. The power supply further includes electrical load means for providing an electrical load. Additionally, the power supply contains measuring means for measuring a voltage of the output of the voltage transformation means. Finally, the power supply includes switching means responsive to the measuring means for electrically connecting the electrical load means across the output of the power supply.

The present invention further provides a method for coupling an electrical load to a switching power supply having an output and having a transformer with a secondary winding. The method includes the step of providing an electrical load. The method further includes the step of measuring a voltage across the secondary winding of the transformer. Finally, the method includes the step of coupling the electrical load across the output of the power supply.

The apparatus and method provided by the present invention assure that at least a minimum load is provided to the output of a power supply at all times. Further, the present invention avoids the disadvantages of providing a load resistor constantly connected across the output of the power supply.

DETAILED DESCRIPTION OF THE PREFERRED EMBODIMENT

Figure 1:
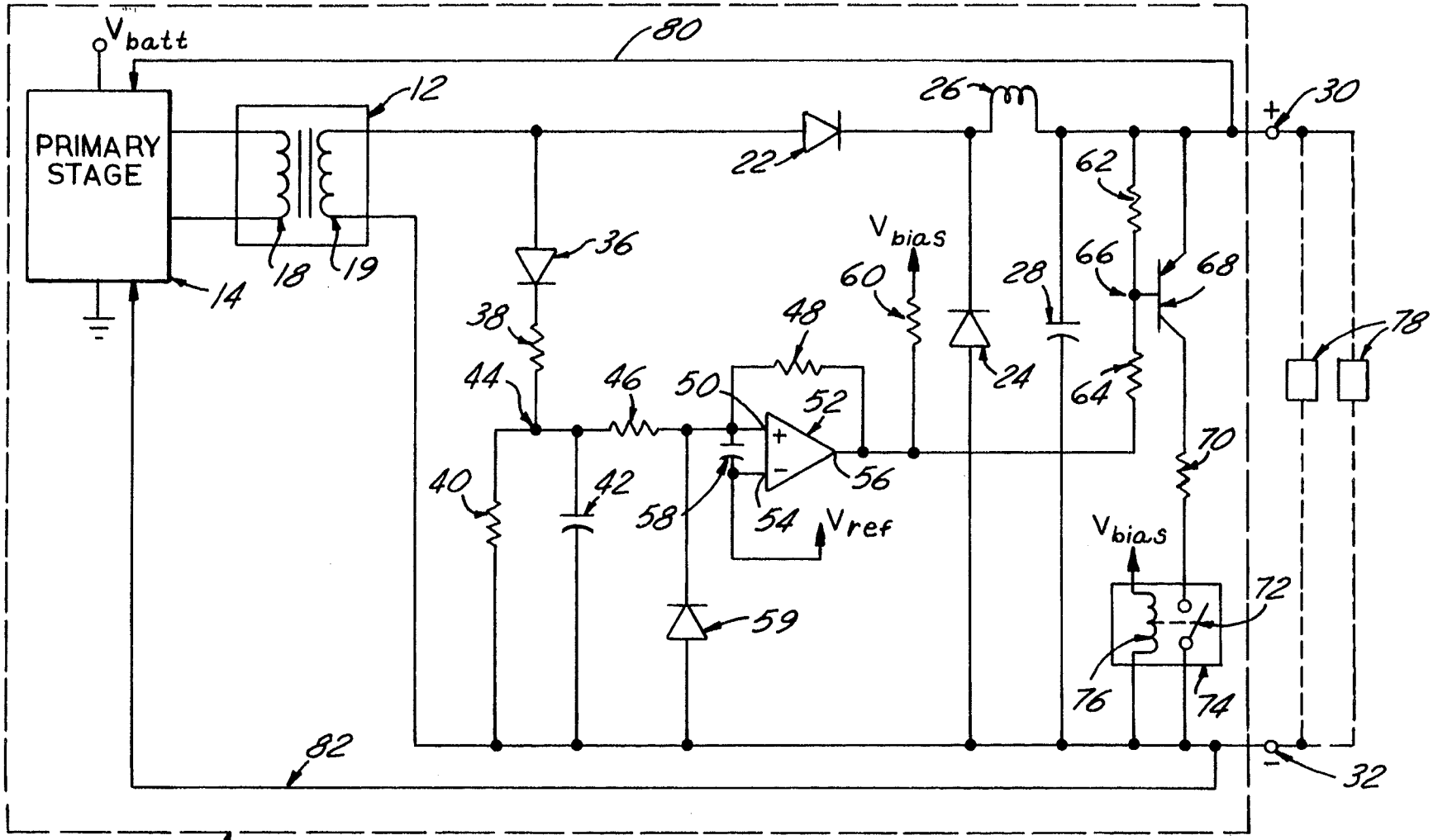
FIG. 1 is an electrical schematic of a power supply according to the present invention.

Referring to FIG. 1, an electrical schematic representing the preferred embodiment of the present invention is presented. Power supply 10 contains a transformer 12. On the primary side of transformer 12 is a primary stage 14 connected between a DC power source and ground. In the preferred embodiment of the present invention, this DC power source is a battery (labelled "$V_{batt}$" in FIG. 1) with a nominal voltage of 336 volts. Primary stage 14 contains electrical circuitry capable of switching voltage across primary winding 18 with the goal of producing a waveform across secondary winding 19 having an average value approximately equal to the desired DC output voltage of power supply 10. The construction of primary stage 14 can be according to a number of configurations well-known to those skilled in the art of switching power supplies.

On the secondary side of transformer 12 are two diodes 22 and 24. Additionally, inductor 26 and capacitor 28 form a low-pass L-C filter. The output of power supply 10 appears across positive output terminal 30 and negative output terminal 32 of power supply 10.

Connected across secondary winding 19 of transformer 12 are a diode 36, a resistor 38 (preferably 4.7 kΩ) and the parallel combination of a resistor 40 (preferably 1 kΩ) and a capacitor 42 (preferably 10 μF). A resistor 46 (preferably 7.5 kΩ) connects node 44 with non-inverting input 50 of a comparator 52. Comparator 52 is preferably of the LM2903 type manufactured by, for example, Motorola. Output 56 and non-inverting input 50 of comparator 52 are connected via resistor 48 (preferably 10 MΩ). Non-inverting input 50 and inverting input 54 of comparator 52 are connected by a capacitor 58. A constant reference voltage $V_{ref}$ is supplied to inverting input 54 of comparator 52. A pull-up resistor 60 connects a voltage supply $V_{bias}$ to output 56 of comparator 52. $V_{bias}$ is a DC voltage source which is on only when power supply 10 is intended to be on.

Connected within power supply 10 between positive output terminal 30 of power supply 10 and output 56 of comparator 52 are resistors 62 and 64. Node 66, between resistors 62 and 64, is connected to the base of a p-n-p transistor 68. The emitter of transistor 68 is connected to positive output terminal 30 of power supply 10. The collector of transistor 68 is connected to one side of a dummy load resistor 70. The other side of dummy load resistor 70 is connected to a normally open contact 72 of a relay 74. The other side of normally open contact 72 is connected to output terminal 32 of power supply 10. Coil 76 of relay 74 is connected between bias voltage $V_{bias}$ and output terminal 32 of power supply 10.

Loads 78, which are supplied power by power supply 10, are connected between positive output terminal 30 and negative output terminal 32. In the preferred embodiment of the present invention, loads 78 include a 12-volt automotive battery which is charged by power supply 10. Feedback paths 80 and 82 provide feedback of the output voltage of power supply 10 (i.e., the voltage across positive output terminal 30 and negative output terminal 32) to primary stage 14. The voltage feedback provided by feedback paths 80 and 82 is a common feature in switching power supplies.

The operation of power supply 10 is as follows. Primary stage 14 switches voltage across primary winding 18 of transformer 12 with a predetermined frequency and a variable duty cycle. The preferred frequency is 125 kHz. The duty cycle at any moment in time is such that the voltage appearing at the output of power supply 10 (as fed back to primary stage 14 by feedback paths 80 and 82) is the desired output voltage of power supply 10. The preferred output voltage of power supply 10 is 13.8 volts.

On the secondary side of transformer 12, diode 22, diode 24, inductor 26 and capacitor 28 form the circuitry seen on the secondary side of a typical switching power supply. Diode 22 rectifies the signal across secondary winding 19. Inductor 26 and capacitor 28 low-pass-filter the signal, extracting essentially the average value of the rectified voltage across secondary winding 19 (with a diode drop occurring at diode 22). The remaining components on the secondary side of transformer 12 act according to the present invention to assure a predetermined minimum electrical load across positive output terminal 30 and negative output terminal 32 of power supply 10, even if some or all of loads 78 become disconnected.

Figure 2:
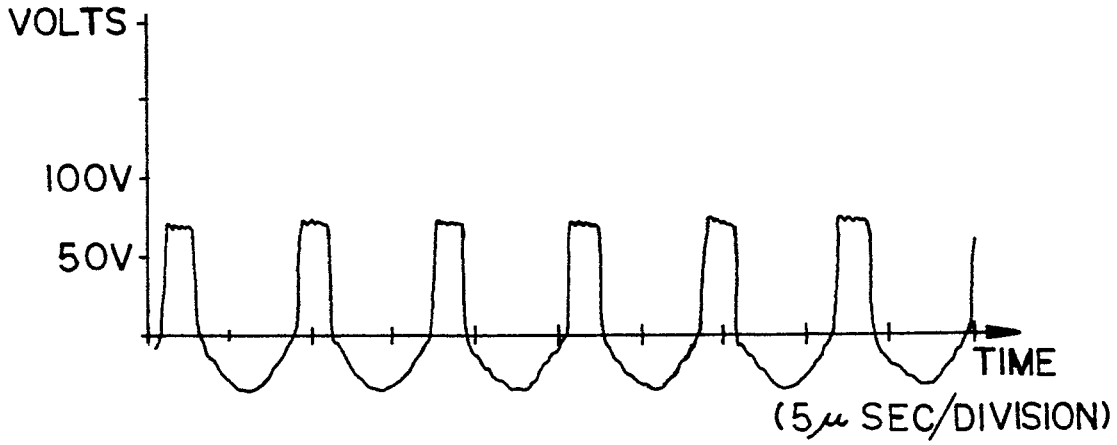
FIG. 2 is a plot of the voltage across secondary winding 19 of transformer 12 of FIG. 1 with a normal electrical load on the output of power supply 10.
Figure 3:
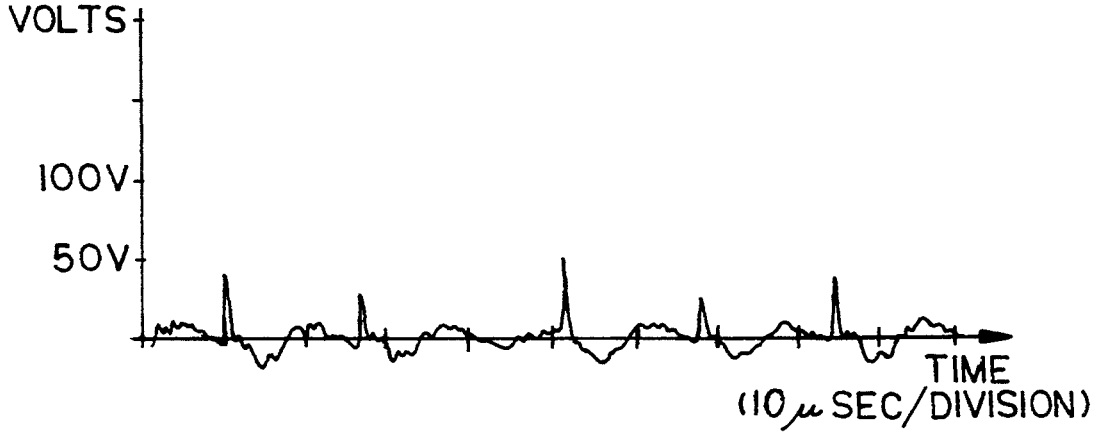
FIG. 3 is a plot of the voltage across secondary winding 19 of transformer 12 of FIG. 1 with no electrical load on the output of power supply 10.

During normal operation of switching power supply 10, the voltage across secondary coil 19 is generally as shown in FIG. 2. FIG. 2 illustrates the voltage across secondary coil 19 when a current of approximately five amperes (an adequate electrical load) is supplied from positive output terminal 30 of power supply 10. On the other hand, FIG. 3 shows the voltage across secondary coil 19 when a load of zero amperes (an inadequate electrical load) is supplied from positive output terminal 30. It is apparent that the area under the curve above the x-axis in FIG. 2 is considerably larger than the area under the curve above the x-axis in FIG. 3. It is that difference that the present invention exploits to detect that an inadequate electrical load is connected between positive output terminal 30 and negative output terminal 32.

The output from secondary winding 19 is rectified by diode 36. The rectified signal is then voltage-divided by the combination of resistor 38 and resistor 40. Further, the low-pass filter formed by resistor 38 and capacitor 42 removes the highest-frequency components of the signal. The output of the low-pass filter, at node 44, thus approaches the average value of the rectified voltage across secondary winding 19.

This signal is fed into non-inverting input 50 of comparator 52. Comparator 52 compares the signal with $V_{ref}$, which is present at inverting input 54. $V_{ref}$ is preferably 2.5 volts and is preferably provided by a Motorola TL431A11P reference regulator. If the signal at non-inverting input 50 (i.e., the average voltage of the rectified signal across secondary winding 19) is less than 2.5 volts, output 56 of comparator 52 goes low. This occurs when there is inadequate electrical load connected between positive output terminal 30 and negative output terminal 32. Otherwise, the output 56 of comparator 52 stays high.

Resistors 46 and 48 provide hysteresis in the switching of output 56 between high and low states. Capacitor 58 helps filter out common mode noise.

If output 56 of comparator 52 has gone low, transistor 68 is turned on. Dummy load resistor 70 (preferably eight ohms) is thus electrically connected between positive output terminal 30 and negative output terminal 32, as long as contact 72 of relay 74 is closed. (As will be discussed immediately below, contact 72 is in fact closed whenever power supply 10 is operating). Thus a load of 1.7 amperes at 13.8 volts is provided by dummy load resistor 70.

Relay 74 is included in order to prevent current flow between positive output terminal 30 and negative output terminal 32 when power supply 10 is intended to be off. Coil 76 is energized by constant voltage source $V_{bias}$ whenever power supply 10 is intended to be on. Without relay 74 in series with transistor 68, some current could flow from positive output terminal 30 to negative output terminal 32 even when power supply 10 is intended to be off. Such a situation could occur because loads 78 include a 12-volt battery in the preferred embodiment of the present invention. Even if output 56 of comparator 50 is not sinking current, transistor 68 can be partially conducting due to the 12-volt battery at the emitter of transistor 68. This conduction can occur because the 12-volt battery forward-biases the emitter-base junction of transistor 68. The conduction would drain the 12-volt battery connected as one of loads 78. Relay 74, which opens when $V_{bias}$ is turned off, prevents such current flow.

Various modifications and variations will no doubt occur to those skilled in the arts to which this invention pertains. Such variations which generally rely on the teachings through which this disclosure has advanced the art are properly considered within the scope of this invention. This disclosure should thus be considered illustrative, not limiting, the scope of the invention instead being defined by the following claims.

What is claimed is:

1. A switching power supply with an output, said power supply comprising:

voltage transformation means with an output;

electrical load means for providing an electrical load;

a low-pass filter coupled to said output of said voltage transformation means, said low-pass filter having an output;

comparison means coupled to said output of said low-pass filter for generating a first voltage if said output of said low-pass filter is below a pre-determined voltage; and first switching means coupled to said comparison means for electrically connecting said electrical load means across said output of said power supply if said comparison means generates said first voltage.

2. A switching power supply as recited in claim 1 wherein said voltage transformation means comprises a transformer.

3. A switching power supply as recited in claim 2 further comprising a rectifier coupled between said voltage transformation means and said low-pass filter.

4. A switching power supply as recited in claim 3 wherein said comparison means comprises a comparator coupled to said output of said low-pass filter.

5. A switching power supply as recited in claim 4 wherein said electrical load means comprises a load resistor.

6. A switching power supply as recited in claim 1 further comprising second switching means for connecting and disconnecting said electrical load means across said output of said power supply.

7. A switching power supply as recited in claim 6 wherein said second switching means comprises a relay.

8. A switching power supply as recited in claim 1 wherein:

said power supply further comprises a filter inductor coupled in series between said output of said voltage transformation means and said output of said switching power supply;

wherein said low-pass filter is coupled to a point between said output of said voltage transformation means and said filter inductor.

9. A switching power supply with an output, said power supply comprising:

a transformer with a secondary winding;

a dummy electrical load;

a rectifier coupled to said secondary winding;

a low-pass filter coupled to said rectifier, said low-pass filter having an output;

a comparator with an input and an output, said input coupled to said output of said low-pass filter; and a switching device with a control input and a switched output responsive to said control input, said control input coupled to said output of said comparator and said switched output coupled to said load resistor;

wherein said comparator and said transistor are configured such that said transistor conducts current through said dummy electrical load if said output of said low-pass filter is below a predetermined voltage.

10. A switching power supply as recited in claim 9 wherein:

said switching power supply further comprises a filter inductor coupled in series between said secondary winding of said transformer and said output of said switching power supply;

wherein said low-pass filter is coupled to a point between said output of said transformer and said filter inductor.

11. A switching power supply as recited in claim 10 wherein:

said switching device is a transistor;

said control input is a base of said transistor; and said switched output is a collector of said transistor.

12. A switching power supply as recited in claim 11 further comprising a relay with contacts coupled in series with said dummy load.

13. A switching power supply as recited in claim 12 wherein said dummy electrical load comprises a load resistor.

14. A method for coupling an electrical load to a switching power supply having an output and having a transformer with a secondary winding, said method comprising the steps of:

providing an electrical load;

low-pass filtering an output signal from said secondary winding to generate a low-pass filtered signal;

comparing said low-pass filtered signal to a predetermined value; and coupling said electrical load across said output of said switching power supply if said low-pass filtered signal has a voltage less than said predetermined value.

15. A method for coupling an electrical load as recited in claim 14 further comprising the step of rectifying said output signal from said secondary winding prior to low-pass-filtering said signal.

* * * * *